US010901370B2

(12) United States Patent
Vuille et al.

(10) Patent No.: US 10,901,370 B2
(45) Date of Patent: Jan. 26, 2021

(54) SAFETY VALVE FOR WATCHES

(71) Applicant: The Swatch Group Research and Development Ltd, Marin (CH)

(72) Inventors: Pierry Vuille, Les Emibois (CH); Michel Willemin, Preles (CH); Jean-Claude Martin, Montmollin (CH)

(73) Assignee: The Swatch Group Research and Development Ltd, Marin (CH)

( * ) Notice: Subject to any disclaimer, the term of this patent is extended or adjusted under 35 U.S.C. 154(b) by 237 days.

(21) Appl. No.: 16/012,817

(22) Filed: Jun. 20, 2018

(65) Prior Publication Data

US 2019/0018370 A1 Jan. 17, 2019

(30) Foreign Application Priority Data

Jul. 14, 2017 (EP) ..... 17181526

(51) Int. Cl.
*G04B 37/10* (2006.01)
*G04B 37/02* (2006.01)

(52) U.S. Cl.
CPC ..... *G04B 37/10* (2013.01); *G04B 37/02* (2013.01); *G04B 37/103* (2013.01); *G04B 37/106* (2013.01)

(58) Field of Classification Search
CPC ..... G04B 37/088; G04B 37/02; G04B 37/10; G04B 37/103; G04B 37/106; F16K 17/02
USPC ..... 368/291, 289–290, 288, 308, 319–321
See application file for complete search history.

(56) References Cited

U.S. PATENT DOCUMENTS 3,994,125 A * 11/1976 Wenger ..... G04B 3/046 368/290
5,257,247 A * 10/1993 Miche ..... G04B 37/103 368/290
2007/0025190 A1* 2/2007 Cretin ..... G04B 3/046 368/319
2014/0010055 A1 1/2014 Briswalter et al.

FOREIGN PATENT DOCUMENTS

| | | |
|---|---|---|
| BE | 661940 | 10/1965 |
| CH | 492 246 | 11/1969 |
| EP | 2 685 327 A1 | 1/2014 |
| GB | 303102 | 7/1929 |
| JP | 61-256275 | 11/1986 |

OTHER PUBLICATIONS

European Search Report dated Feb. 5, 2018 in European Application No. 17181526.9 filed on Jul. 14, 2017 (with English Translation of Categories of Cited Documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A safety valve for a watch including a head that is movably mounted on a tube and able to move between an open position and a closed position, the tube including in its internal volume a first spring and wherein the tube is provided on an external face with a cam surface allowing a manual movement and an automatic movement of the head into its open position, after the first spring, the tube includes a second spring having a higher stiffness than that of the first spring.

16 Claims, 4 Drawing Sheets

SAFETY VALVE FOR WATCHES

This application claims priority from European Patent Application No. 17181526.9 filed on Jul. 14, 2017, the entire disclosure of which is hereby incorporated herein by reference.

FIELD OF THE INVENTION

The present invention relates to a safety valve for a watch, and more specifically for a wristwatch intended for underwater diving. The present invention also relates to the watch provided with said valve.

BACKGROUND OF THE INVENTION

Helium escape valves are present in some dive watches for removing helium that has penetrated the watch case during saturation dives where divers inhale a gas mixture containing helium and oxygen. This allows them to stay inside a diving bell or underwater habitat for several days. During this time period, helium may penetrate the watch. In the absence of such a valve, the excess internal pressure caused by helium that has seeped in may, during the decompression phase, cause damage to the watch, such as, for example, loss of the crystal which may pop out or break.

Helium escape valves can be manual or automatic. Manual valves operate simply by tightening a sealing element, such as a head, onto the case middle, in the same way as a screw-in crown. Manual valves have the drawback that the watch is not water-resistant if the valve is not tightened up again after use. Automatic valves are activated automatically, as their name indicates, when the difference in pressure between the inside of the watch case and the external environment reaches a critical threshold. A first type of automatic valve is one that the user cannot block, the principles of which are described in Swiss Patent No CH491246. This valve, which, in most cases, is mounted flush with the case middle takes the form of a simple valve limiting the pressure inside the watch case. The drawback of this type of valve is that it opens automatically with no possibility of stopping gas escaping and therefore of fluid entering the watch, which is problematic when decompression is performed in a humid environment. To overcome this drawback, there is a second type of automatic valve which can be operated by the user by screwing/unscrewing the head, as described in European Patent No EP0554797. This second type of valve could be incorporated in a push button as disclosed in European Patent No EP2685327.

The valve of EP0554797 includes a hollow head provided with a skirt and a central core extended by a shaft. The head can be screwed onto a tube attached to the case middle forming part of the timepiece case. The tube includes a bottom through which the shaft passes with clearance. The core and the shaft are surrounded by a helical return spring. The spring is supported under the head via its first end. The second end of the spring is supported on a ring which in turn compresses a first sealing gasket disposed on the bottom of the tube. A second sealing gasket is arranged under the head opposite to the tube. When the head is screwed onto the threaded portion of the tube, the second sealing gasket is pressed against the tube. Thereafter, the valve is inoperative and completely sealed via the second gasket and the effect of the spring on the first gasket. When the head is unscrewed, the second gasket under the head is no longer active and the gasket at the bottom of the tube is able to rise up against the return force of the spring when the pressure within the case becomes higher than the pressure outside. Gas is then evacuated from the interior of the watch to the exterior.

This second type of valve has several drawbacks. Firstly, it requires intervention by the user to be active. When the head is held in the closed position, the valve is de facto inoperative and will not prevent the crystal popping out in case of overpressure inside the case. Next, the head is mounted on the tube via a screw thread. Given that, throughout its life, the head is mainly in the rest position, i.e. the screwed-in position, there is a risk that the user will no longer be able to loosen it when the time comes. Further, excessive tightening of the head onto the tube risks, over time, damaging the second gasket positioned under the head. Conversely, insufficient tightening of the head risks keeping it in the open position.

SUMMARY OF THE INVENTION

To overcome the aforecited drawbacks, it is a main object of the present invention to propose a new helium escape valve that combines the advantages of automatic valves, respectively with and without intervention by the user, while avoiding the drawbacks of a screw/nut connection specific to automatic valves requiring intervention by the user.

To this end, the present invention proposes a valve with two operating configurations. In a first configuration, the valve is active beyond a moderate overpressure threshold inside the watch case, provided that the user has previously placed the valve head in an open position to allow gas to escape towards the exterior of the watch. In a second configuration, the valve is active beyond a critical overpressure threshold inside the watch case causing the head to open automatically. Operation with two distinct overpressure thresholds is made possible, on the one hand, by means of a cam type connection between the head and tube of the valve and, on the other hand, by the presence of two springs arranged in series inside the valve which have different stiffnesses. More specifically, in the first configuration, the opening and closing of the head is controlled manually by the user by rotating the head and sliding the latter over a cam surface arranged on the tube, which transforms the rotational motion into a translational motion. A first spring is sized such that the valve is operational in this configuration when a given internal overpressure threshold is reached. In the second configuration, a second spring is sized such that the valve is operational for a given overpressure threshold which is higher than that of the first configuration. In this second configuration, the automatic opening of the head under the effect of internal pressure is made possible by the fact that the head is mounted on a cam surface which, unlike the screw thread, allows for a purely translational motion of the head. Further, this assembly avoids the inherent problems of excessive or insufficient tightening of the head by the user.

Other advantages will appear from the features set out in the claims, and from the detailed description of the invention illustrated hereinafter with reference to the annexed drawings, provided as non-limiting examples.

BRIEF DESCRIPTION OF THE DRAWINGS

In FIGS. 5 and 6 the head is in the closed position. In FIG. 8 a difference in pressure between the interior and exterior of the watch case results in gas escaping towards the exterior of the watch case.

DETAILED DESCRIPTION OF THE INVENTION

The present invention relates to a helium escape valve, which will also be referred to as a safety valve.

Figure 1:
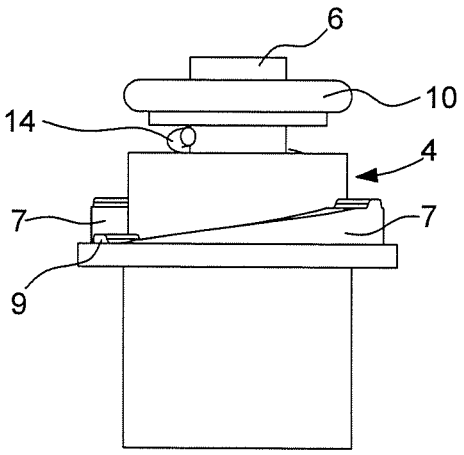
FIG. 1 is a front view of one part of the helium escape valve according to the invention.
Figure 2:
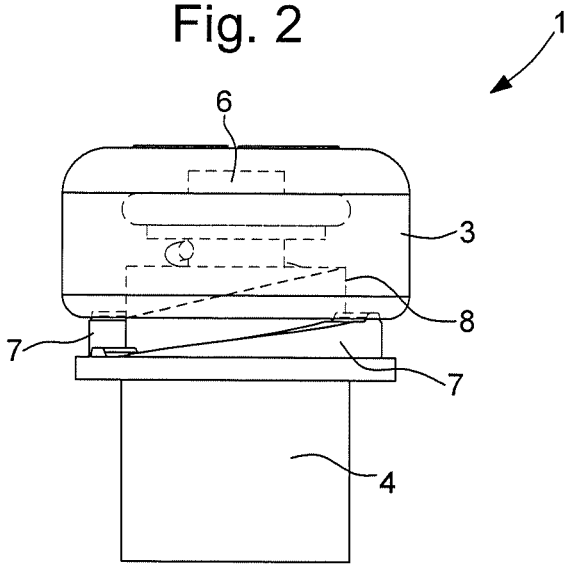
FIG. 2 represents the same view of the whole of the helium escape valve provided with the head, with the ramps arranged in said head transparently visible.
Figure 3:
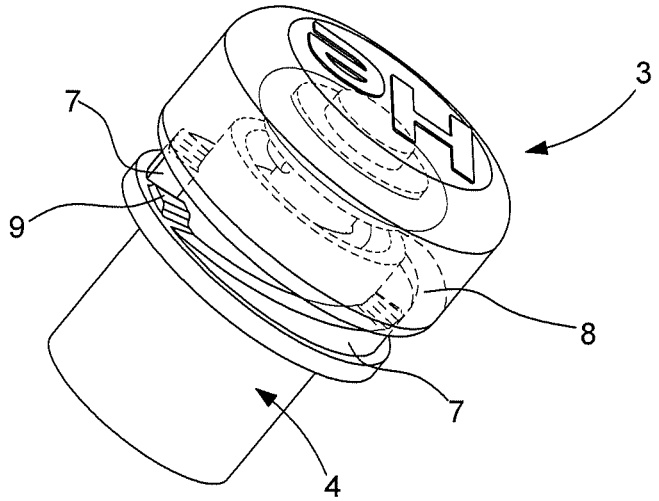
FIG. 3 is a perspective view of the helium escape valve according to the invention.
Figure 5:
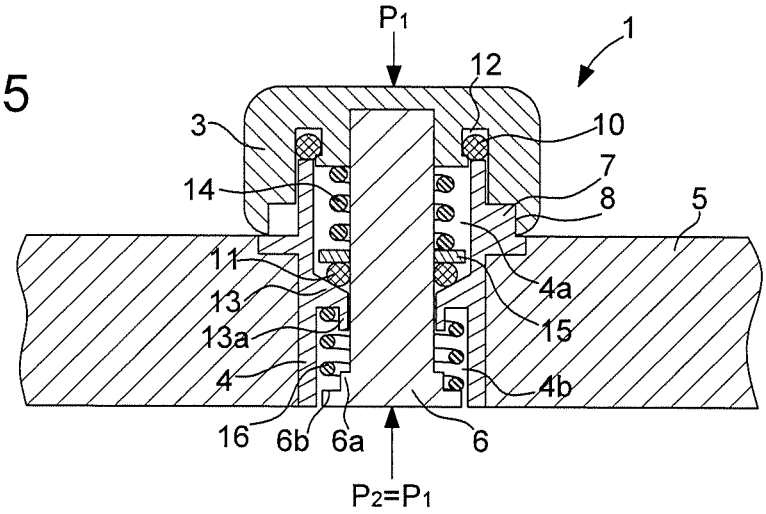
FIGS. 5 and 6 are cross-sectional views of the helium escape valve of the invention fixed to a watch case.

Valve 1 represented, amongst others, in FIGS. 2, 3 and 5, includes a hollow cylindrical head 3 mounted on a tube 4 intended to be fixed to watch case 5, for example by screwing down. Valve 1 includes a shaft 6 integral with head 3, which extends inside the volume delimited by the hollow head and by the tube. According to the invention, head 3 is movably mounted on tube 4 and moves axially between a closed position and an open position respectively represented in FIGS. 5 and 7. The head can move axially in a purely translational motion or move axially via a rotational motion transformed into a translational motion by a cam type contact between the head and the tube. To this end, tube 4 is provided, on its upper external face, and more specifically on its external face outside the watch case, with a cam surface 7 formed of one or more ramps on which head 3 slides when the user imparts a rotational movement to the latter (FIGS. 1 and 2). The tube can be provided with a single ramp occupying an arc comprised between 15 and 360°. Preferably, the tube is provided with at least two ramps to ensure that the head rests on the tube at several points when the head is in the open position. These different ramps have the same geometry (same length, same height) and, preferably, they are arranged in an equidistant manner so that the seat of the head is perpendicular to the longitudinal axis formed by the tube when the head is open. Where there are two ramps, each ramp occupies an arc of less than or equal to 180°. Where there are three ramps, each ramp occupies an arc of less than or equal to 120°. In the example illustrated in FIGS. 1 to 3, tube 4 is provided on its upper external face with two ramps 7, each occupying an arc of slightly less than 180°. Each ramp cooperates with recesses 8 of complementary shape made in the inner wall of head 3, as illustrated in FIGS. 2, 3 and 5. Preferably, each ramp comprises, at its ends, notches or stops 9, which inform the user that he has reached end of travel. It is evident that these notches or stops can also be used to position the inscription on valve head 3 in a precise and reproducible manner, so that the piece is always read in the same manner and has the same aesthetics in the closed and/or open position.

As represented in FIG. 5, valve 1 has a double seal with, on the one hand, an O ring gasket 10 disposed opposite the upper end of tube 4 inside an annular housing 12 provided in head 3 and, on the other hand, another gasket 11, referred to below as the first gasket, arranged inside tube 4. According to the invention, the internal volume of the tube is divided into two chambers 4*a*, 4*b*, separated by a step portion 13 traversed by shaft 6. There is a first chamber 4*a* under head 3, followed, in the direction of the base of shaft 6, by a second chamber 4*b*. The first 4*a* and second 4*b* chambers respectively house first spring 14 and second spring 16. The two chambers are separated by step portion 13 serving as support for first O ring gasket 11 arranged in first chamber 4*a*. This step portion may be in the shape of a truncated cone, as in the examples, or possibly flat. It includes a vertical extension 13*a* extending towards the base of shaft 6 and cooperating with a shoulder 6*a* made in shaft 6 to limit the translational motion of the head in the open position.

Figure 4:
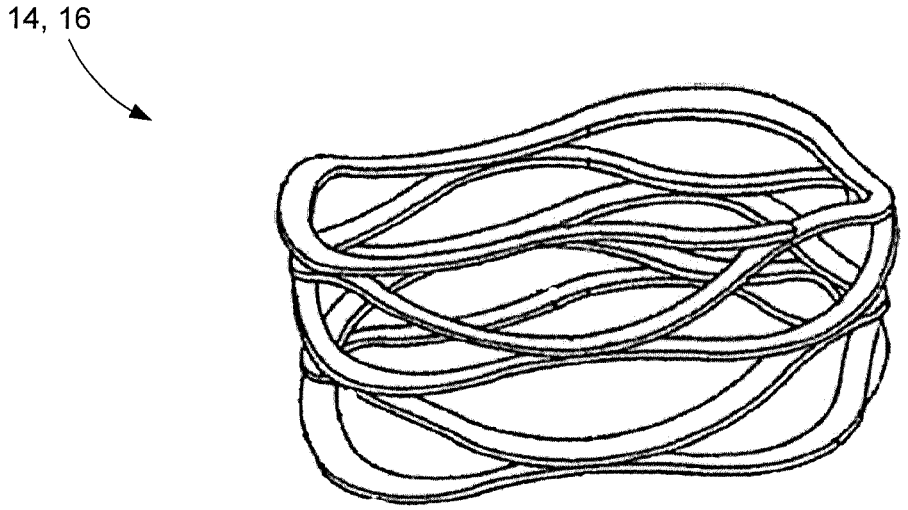
FIG. 4 represents a wave spring which, in a preferred variant of the invention, can be used in the helium escape valve.

In first chamber 4*a*, first spring 14 is wound around shaft 6. This first spring 14 is supported, at one end, under head 3 and, at the other end, on a ring 15 that compresses first gasket 11 against step portion 13. In second chamber 4*b*, second spring 16 is wound around shaft 6. It is supported, at one end, on step portion 13, and at the other end, on a second shoulder 6*b* provided at the base of shaft 6. This second spring 16 is sized to exert a return force on the head and to maintain sufficient closure pressure to ensure the sealing of the valve. According to the invention, it has a stiffness that is higher than that of the first spring, the stiffness of the two springs being calculated as a function of the pressure thresholds above which the valve must be operative. By way of example, first spring 14 can be dimensioned so that the overpressure value $\Delta Px$ inside the valve that releases first gasket 11 is higher than or equal to 1 bar, preferably to 2 bar, whereas second spring 16 can be dimensioned to release gasket 10 under head 3 at a delta pressure $\Delta Py$ between the interior and exterior that is higher than or equal to 3 bar, preferably to 4 bar. The springs may be helical springs. In a preferred variant, they may be crest-to-crest springs, also known as wave springs, as represented in FIG. 4, which offer the advantage of occupying less space compared to a helical spring of equivalent stiffness. The superposition of Schnorr or Belleville washers is also envisaged.

Figure 6:
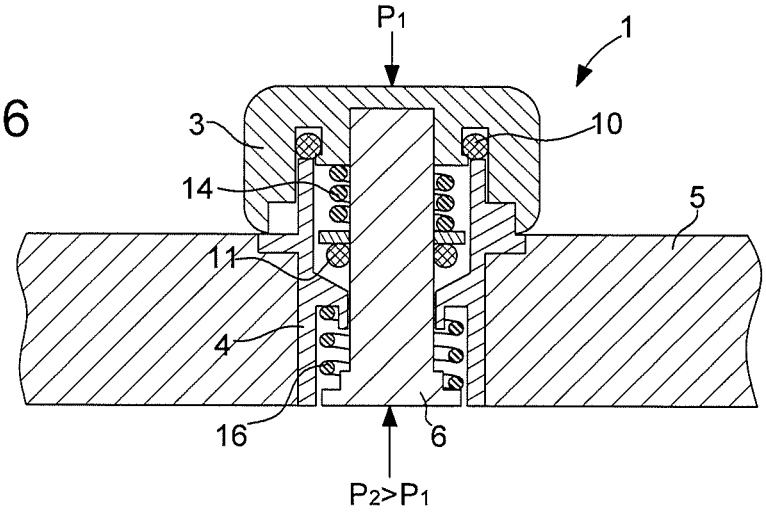
Figure 7:
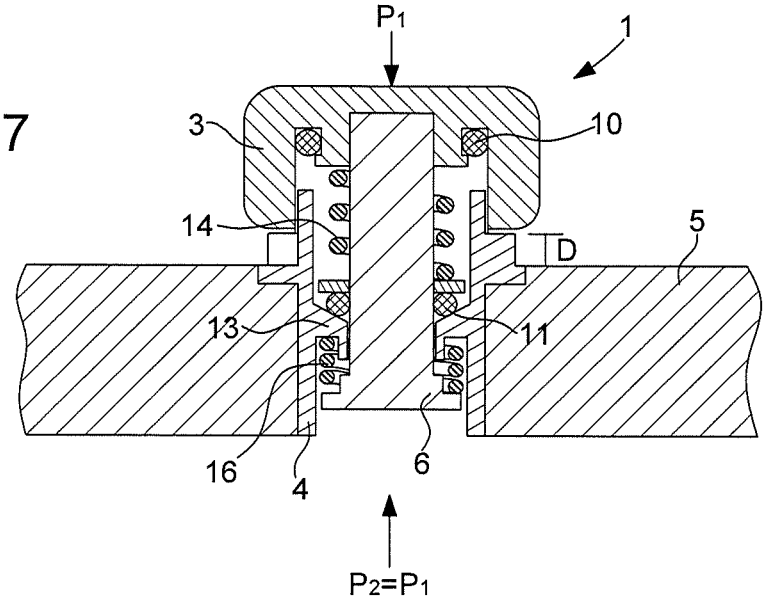
In FIGS. 7 and 8 the head is in the open position following intervention by the user.
Figure 8:
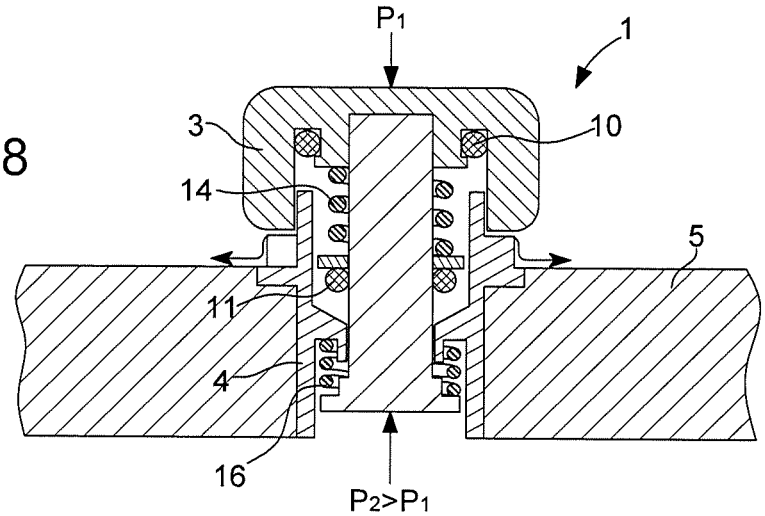
Figure 9:
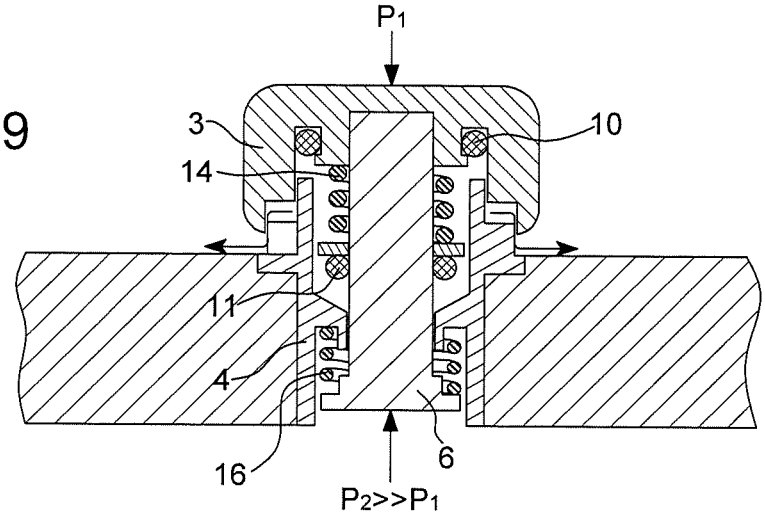
In FIG. 9, the head is in the open position without intervention by the user, following significant overpressure inside the watch case.

FIGS. 5 to 9 illustrate the operation of the valve according to the invention. In FIGS. 5 and 6, the head is in the closed position, i.e. the user has not rotated the head. If there is no difference in pressure between the interior of the watch case (pressure P2) and the external environment (pressure P1=P2), the two gaskets 10, 11 are compressed and the valve is completely sealed (FIG. 5). In the presence of moderate overpressure inside the watch case (P2>P1), shaft 6 is held in the low position by the return force of second spring 16, whereas first gasket 11 is no longer active due to the helium pressure lifting the latter (FIG. 6). Nonetheless, the sealing of the valve is ensured by gasket 10 under the head. In the presence of significant overpressure inside the watch case (P2>>P1), the return force of second spring 16 is no longer able to counteract the internal pressure (FIG. 9). Consequently, shaft 6 rises up, releasing the two gaskets 10, 11 and thereby allowing gas to escape through the two chambers and the space between the external face of the tube and the inner circumference of the head.

When the user rotates the head to place it in the open position as shown in FIGS. 7 and 8, the head moves axially by a distance D corresponding to the height of the ramp, which makes gasket 10 inactive under head 3. If the internal pressure is equal to the external pressure (P1=P2), first gasket 11 remains compressed against support step 13 and consequently the valve remains sealed (FIG. 7). Conversely, when the internal pressure exceeds the external pressure (P2>P1) by a predefined value sufficient to counteract the return force of first spring 14, first gasket 11 also becomes inoperative, which allows gas to escape outside the watch case to balance the pressures (FIG. 8).

Figure 10:
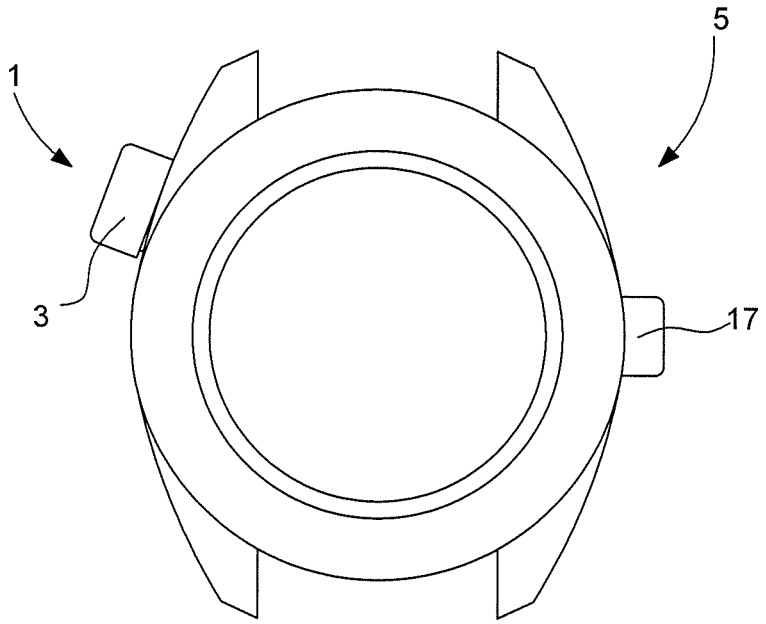
FIGS. 10 and 11 represent a watch case provided with a helium escape valve according to the invention, with the head respectively in the closed position and in the open position.
Figure 11:
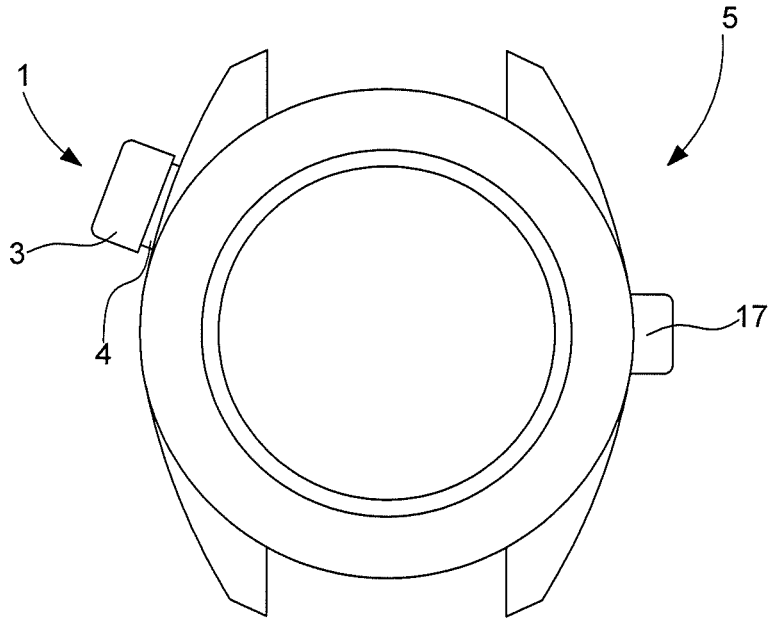

Finally, FIGS. 10 and 11 illustrate watch case 5 comprising valve 1 according to the invention in the closed and open positions respectively. Optionally, tube 4, which is visible when head 3 is in the open position, can be marked on its external face with a logo or colour to indicate to the user that the head is in the open position.

LIST OF PARTS (1) Valve
(3) Head
(4) Tube
(4*a*) First chamber
(4*b*) Second chamber
(5) Watch case
(6) Shaft
(6*a*) First shoulder
(6*b*) Second shoulder
(7) Cam surface or ramp
(8) Recess in the head
(9) Notch on the ramp
(10) Gasket under the head
(11) Other or first gasket
(12) Housing
(13) Step portion
(13*a*) Stop
(14) First spring
(15) Ring
(16) Second spring
(17) Distinct push-piece for the valve according to the invention

What is claimed is:

1. A safety valve comprising:

a tube configured to be fixed to a watch case and a hollow head provided with a shaft extending into a hollow part of the head, said head being movably mounted on the tube and able to move along an axis defined by the shaft between an open position, wherein a fluid overpressure inside the watch case is capable of escaping, and a closed position wherein fluid is prevented from escaping, said tube comprising, in its internal volume, a first spring wound around the shaft, the tube being further wherein:

an external face of said tube is provided with a cam surface, respectively, allowing a manual movement of the head to its open position following intervention by a user and an automatic movement of the head towards its open position in response to a critical overpressure inside the watch case, and the tube includes a second spring wound around the shaft with the second spring separated from the first spring by a step portion traversed by the shaft and integral with the tube, the first spring being dimensioned so that the valve is active in response to an overpressure ΔPx inside the watch case after manual movement of the head into its open position, the second spring being sized so that the valve is active in response to an overpressure ΔPy inside the watch case causing automatic movement of the head into its open position, the second spring having a higher stiffness than that of the first spring so that overpressure ΔPy is higher than overpressure ΔPx.

2. The valve according to claim 1, wherein the cam surface is formed of one or more ramps cooperating with recesses of complementary shape made in the inner wall of the head.

3. The valve according to claim 2, comprising to ramps each extending over an arc of less than or equal to 180°.

4. The valve according to claim 2, wherein the ramps are arranged in an equidistant manner.

5. The valve according to claim 2, wherein each ramp comprises stop notches at its ends.

6. The valve according to claim 5, wherein the stop notches or stops are used to set, in a reproducible manner, the position of an inscription or of a logo arranged on the head in the closed and/or open position.

7. The valve according to claim 1, wherein the tube includes in its internal volume two chambers, separated by the step portion with, in succession starting from the head, a first chamber housing the first spring and a second chamber housing the second spring.

8. The valve according to claim 1, wherein the valve includes a gasket arranged facing one end of the tube inside an annular housing arranged in the head and another gasket, also called the first gasket, intended to be supported on the step portion when overpressure ΔPx and overpressure ΔPy are substantially equal to 0.

9. The valve according to claim 8, wherein the first chamber includes a ring arranged between the first spring and the first gasket, one end of the first spring being supported under the head and the other end of the first spring being supported on the ring intended to compress the first gasket against the step portion when overpressure ΔPx and overpressure ΔPy are substantially equal to 0.

10. The valve according to claim 1, wherein one end of the second spring is supported on the step portion and the other end of the second spring is supported on a shoulder arranged at a base of the shaft.

11. The valve according to claim 1, wherein the step portion includes a stop cooperating with the shaft to limit the axial movement of the head towards its open position.

12. The valve according to claim 1, wherein the first spring and the second spring are crest-to-crest springs.

13. The valve according to claim 1, wherein ΔPx is higher than or equal to 1 bar and wherein ΔPy is higher than or equal to 3 bar.

14. The valve according to claim 1, wherein the tube includes a mark on its external face.

15. A watch comprising:

a case formed of a case middle, a back cover and a crystal delimiting a sealed volume in which is mounted a timepiece movement provided with a means for displaying time information, and including a valve including a tube intended to be fixed to a watch case and a hollow head provided with a shaft extending into a hollow part of the head, said head being movably mounted on the tube and able to move along an axis defined by the shaft between an open position, wherein a fluid overpressure inside the watch case is capable of escaping, and a closed position wherein fluid is prevented from escaping, said tube comprising in its internal volume a first spring wound around the shaft, the tube being further wherein:

an external face of said tube is provided with a cam surface, respectively, allowing a manual movement of the head to its open position following intervention by a user and an automatic movement of the head towards its open position in response to a critical overpressure inside the watch case, and the tube includes a second spring wound around the shaft with the second spring separated from the first spring by a step portion traversed by the shaft and integral with the tube, the first spring being dimensioned so that the valve is active in response to an overpressure ΔPx inside the watch case after manual movement of the head into its open position, the second spring being sized so that the valve is active in response to an overpressure ΔPy inside the watch case causing automatic movement of the head into its open position, the second spring having a higher stiffness than that of the first spring so that overpressure ΔPy is higher than overpressure ΔPx, said valve being mounted on the case.

16. The valve according to claim 1, wherein ΔPx is higher than or equal to 2 bar and wherein ΔPy is higher than or equal to 4 bar.

* * * * *